US005284264A

United States Patent [19]

Gross

[11] Patent Number: 5,284,264

[45] Date of Patent: Feb. 8, 1994

[54] TOGGLE-ACTION DISPENSING CLOSURE WITH SLIDE LOCK

[75] Inventor: Richard A. Gross, Oconomowoc, Wis.

[73] Assignee: AptarGroup, Inc., Crystal Lake, Ill.

[21] Appl. No.: 940,001

[22] Filed: Sep. 3, 1992

[51] Int. Cl.[5] ..... B65D 55/02

[52] U.S. Cl. ..... 215/237; 215/206; 222/153; 222/534

[58] Field of Search ..... 215/206, 221, 225, 235, 215/237, 239, 240, 241, 242, 273; 220/254, 281, 324, 334, 338; 222/153, 517, 531, 534, 536, 556

[56] References Cited

U.S. PATENT DOCUMENTS

| | | | |
|---|---|---|---|
| 4,679,712 | 7/1987 | Foster et al. . | |
| 4,718,567 | 1/1988 | La Vange | 215/216 |
| 4,763,801 | 8/1988 | Nycz | 215/203 |
| 4,776,501 | 10/1988 | Ostrowsky . | |
| 4,962,869 | 10/1990 | Gross et al. . | |
| 5,058,775 | 10/1991 | Gross et al. . | |

*Primary Examiner*—Allan N. Shoap
*Assistant Examiner*—Nova Stucker
*Attorney, Agent, or Firm*—Dressler, Goldsmith, Shore & Milnamow, Ltd.

[57] ABSTRACT

A toggle-action container dispensing closure is provided for manipulation between a closed, non-dispensing orientation and an open, dispensing orientation. An actuator is mounted on a body and is tiltable between a closed position and an open position. A locking member is slidably disposed on the actuator for movement between an extended, locked position and a retracted, unlocked position. In the locked position the locking member overlies an abutment surface on the body to prevent pivoting of the actuator to the open position. When the locking member is retracted, the locking member clears the body abutment surface to permit pivoting of the actuator to the open position.

11 Claims, 2 Drawing Sheets

TOGGLE-ACTION DISPENSING CLOSURE WITH SLIDE LOCK

TECHNICAL FIELD

This invention relates to a container toggle-action dispensing closure which can be manipulated between a closed orientation and an open, dispensing orientation. More particularly, this invention provides an improvement for reducing the likelihood of such a closure being inadvertently opened when subjected to arbitrary external forces.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 5,058,775 4,962,869, 4,776,501, 4,645,086 and 3,516,581.

The toggle-action closures, such as those disclosed in the above-referenced U.S. Pat. Nos. 5,058,775, 4,962,869, and 4,776,501, require that the operator push down on a top, rear portion of the closure in order to pivot the actuator portion of the closure to the dispensing orientation.

While the above-discussed closures may function generally satisfactorily for the purposes for which they were designed, it would be desirable to provide an improved dispensing closure with structural and operational advantages.

For example, during shipping, storage, and handling, a closure installed on a container may be inadvertently or accidentally subjected to external forces which cause it to be moved to the open, dispensing position. This can result in spillage of the contents and/or damage of the container as a saleable item.

Some closures, such as those discussed in some of the above-referenced patents, include frangible structures for preventing premature actuation and/or providing evidence of actuation. However, after such closures have been initially opened the first time, the closures can be subsequently opened to the dispensing position whenever a portion of the closure is intentionally or accidentally subjected to an external force.

Accordingly, it would be desirable to provide an improved closure in which the likelihood of inadvertent, premature opening of the closure is eliminated or substantially reduced. Further, it would be beneficial if such an improved closure could operate to prevent inadvertent opening, while at the same time permitting deliberate opening, without damage to the closure.

Also, it would be advantageous if such an improved closure could be incorporated in a design having an aesthetically pleasing exterior configuration substantially free of functional details and outwardly projecting features. Specifically, it would be desirable to provide an improved closure in which the features for preventing inadvertent opening could be substantially contained within a compact, stream-lined profile of the closure.

Further, it would be advantageous if the components of such an improved design could be relatively easily manufactured and readily assembled.

The present invention provides an improved closure which can accommodate designs having the above-discussed benefits and features.

SUMMARY OF THE INVENTION

The present invention provides a novel, toggle-action dispensing closure which includes a lock for preventing, or reducing the likelihood of, an inadvertent, premature opening or actuation of the closure to the dispensing position. The closure can have a contemporary, clean design with all features contained within an aesthetically pleasing profile. The closure components can be relatively easily manufactured and readily assembled. The design can accommodate significant torque that could be applied to the closure during application of the closure to a container with an automatic capping machine.

The closure is adapted to be mounted over the opening in a container, especially a container of the type having a generally flexible wall portion which can be squeezed to assist in dispensing the contents from the container.

The closure includes a body for engaging the container over the opening and defining an abutment surface.

An actuator means is provided on the body adjacent the abutment surface for occluding the flow from the container when the actuator means is in a closed, non-dispensing position and for permitting flow from the container when the actuator means is in an open dispensing position.

The body and actuator means together define a mounting means for pivotably mounting the actuator means on the body to accommodate pivoting movement of the actuator means. This accommodates the application of a force to the actuator means at a first location for pivoting the actuator means from the closed position to the open position.

A locking member is slidably disposed on the actuator means for movement between (1) an extended, locked position and (2) a retracted, unlocked position. In the extended, locked position the locking member overlies the body abutment surface. This prevents pivoting of the actuator means to the open position. When the locking member is in the retracted, unlocked position, the locking member clears the body abutment surface to permit pivoting of the actuator means to the open position.

The locking member can be designed to be selectively moved between the locked and unlocked positions without damaging the closure, and all of the features can be contained within a compact profile.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
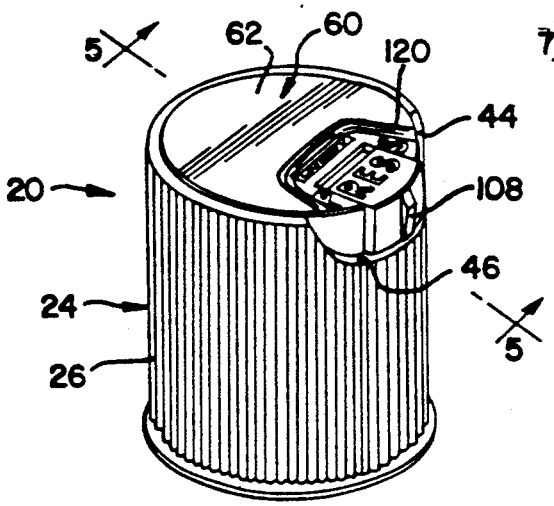
FIG. 1 is a perspective view of the closure of the present invention shown in a locked, non-dispensing, closed orientation.

FIG. 1 shows an embodiment of the dispensing closure of the present invention in the locked closed, non-dispensing position wherein the closure is represented generally by reference numeral 20. The closure 20 is adapted to be mounted on a container (not illustrated) which may have a conventional open mouth defined by a neck (not illustrated) or other suitable structure.

The closure 20 includes a closure base or body 24 for securement to the container. The body 24 includes a generally cylindrical, peripheral wall 26 and a generally transverse closure wall or deck 28 (FIGS. 5 and 6) which extends across the body 24.

The cylindrical wall 26 of the closure base 24 is adapted to engage the outer periphery of the top of the container neck (not illustrated) around the container mouth, as with threads 29. Other suitable engaging means (e.g., snap-fit beads) may be provided to secure the closure base 24 on the container. Alternatively, in some applications the closure base 24 could be non-releasably attached to, or formed unitary with, the container.

Figure 7:
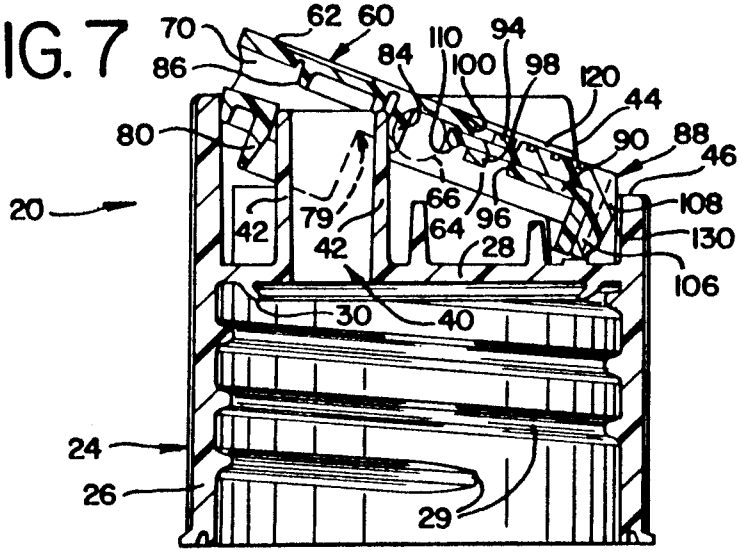
FIG. 7 is a greatly enlarged, fragmentary, cross-sectional view taken generally along the plane 7—7 in FIG. 2.
Figure 5:
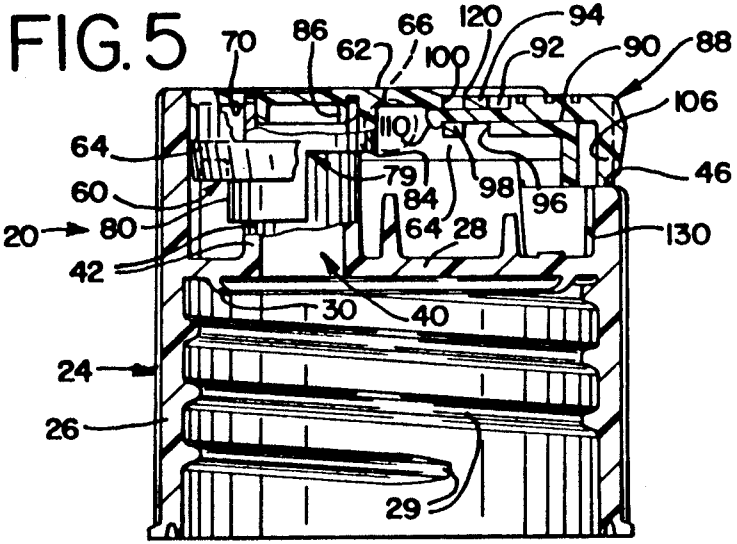
FIG. 5 is a greatly enlarged, fragmentary, cross-sectional view taken generally along the plane 5—5 in FIG. 1.

An annular sealing ring 30 may be provided as shown in FIGS. 5 and 7 for engaging an interior edge of the container neck at the container mouth to effect a tight seal.

Figure 6:
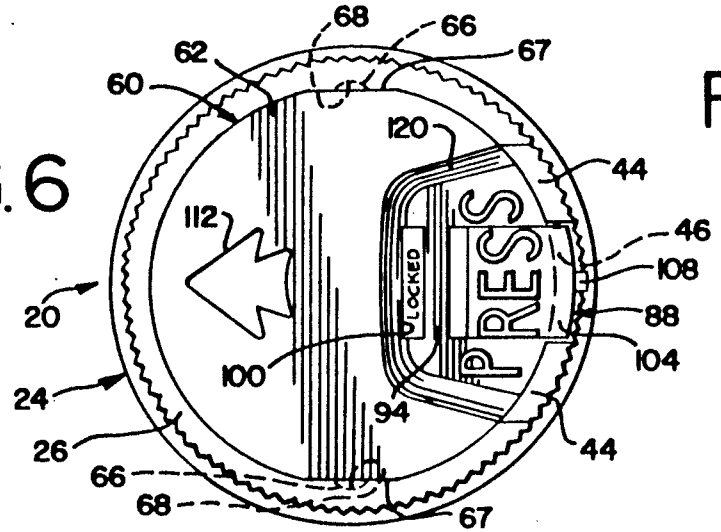
FIG. 6 is a plan view of the locked closed closure shown in FIG. 1.

The closure base 24 includes a discharge aperture or passage 40 through the deck 28 as best illustrated in FIGS. 5 and 6. In the preferred embodiment, the closure base 24 includes a discharge tube 42 projecting upwardly from the deck or flange 28, and the discharge aperture 40 is defined within, and through, the tube 42. The discharge aperture 40 in the tube 42 communicates through the flange 28 with the container interior at the lower end of the tube 42.

Figure 2:
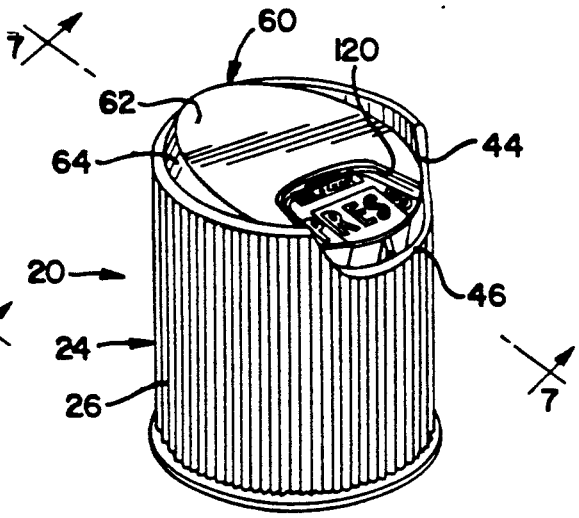
FIG. 2 is a perspective view of the closure shown in an unlocked, open, dispensing orientation.

As shown in FIGS. 2 and 7, the cylindrical wall 26 of the closure body 24 extends upwardly above, and around, the closure body deck 28. A rear portion of the wall 26 above the deck 28 defines a fingerwell or finger recess area 44 in the form of a cutout or notch in the top edge of the wall 26. The bottom of the notch or finger recess area 44 defines an upwardly facing abutment surface 46 for purposes that will become clear hereinafter.

The closure body 24 receives a generally disc-like nozzle assembly, actuator means, or actuator 60. The actuator 60 includes a transverse top wall 62 and a skirt or peripheral flange 64 (FIGS. 2, 4, 5, and 7). At each of two diametrically opposed portions of the flange 64 there is a projecting, hemispherical protuberance or pivot member 66 (FIGS. 5-8). Each hemispherical pivot member 66 projects from a small, flattened sidewall region 67 of the flange 64.

Figure 4:
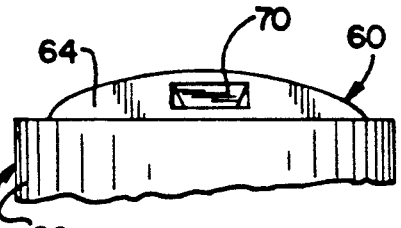
FIG. 4 is a fragmentary, front elevational view of the closure in the open orientation shown in FIG. 3.

The pivot members 66 cooperate with the closure body wall 26 to mount the actuator 60 for pivoting movement within the closure body 24. To this end, the inner surface of the closure body wall 26 defines two hemispherical recesses 68 (FIGS. 6 and 8) for each mating with one of the pivot members 66 to provide a snap-action engagement of the pivot member 66. This accommodates the pivoting movement of the actuator 60 about a pivot axis defined by the pivot members 66 and receiving recesses 68. Thus, the actuator members 66 and body recesses 68 function as mounting means so that the actuator 60 can be pivoted (by pushing downwardly on the rear portion of the actuator 60) until the forward end is exposed above the closure body wall 26 as illustrated in FIGS. 2, 4, and 7.

The actuator 60 includes a structure on the bottom surface of the top wall 62 which functions—depending upon the orientation of the actuator 60—to either permit dispensing of flowable material from the body discharge tube 42 or occlude the passage 40 to prevent flow out of the discharge tube 42. In particular, as shown in FIGS. 4, 5 and 7, the actuator 60 includes a forwardly extending nozzle or channel 70 which merges with, and opens into, a stepped, cylindrical sealing wall 79.

The wall 79 surrounds and seals the upper periphery of the discharge tube 42 when the actuator 60 is in the closed position as illustrated in FIG. 6. In particular, the wall 79 forms a seal around the outer periphery of the discharge tube 42 as indicated by reference number 80 at the front of the tube 42 and as indicated by the reference numeral 84 at the rear of the tube 42.

Preferably, a sealing plug 86 projects downwardly from the bottom of the actuator top wall 62. The sealing plug 86 has a generally cylindrical or annular configuration and is adapted to enter into the opening at the top of the discharge tube 42 to sealingly occlude the discharge aperture 40 in the tube 42 when the actuator is in the closed position as illustrated in FIG. 5.

On the other hand, when the rear of the actuator 60 is pushed down to tilt the actuator to the dispensing position as illustrated in FIG. 7, then the front portion of the sealing plug 86 is tilted away from the top of the discharge tube 42 to permit flow of the material out of the discharge aperture in the tube 42 and through the dispensing nozzle 70. When the actuator 60 is tilted to the dispensing position as illustrated in FIG. 7, the wall 79 still continues to seal the outer periphery of the upper end of the discharge tube 42 so that the container contents, while being dispensed into the nozzle 70, cannot leak out around the top of the discharge tube 42.

A locking member 88 is slidably disposed on the actuator 60 for movement between (1) and extended locked position (FIGS. 1, 5, and 6) in which the locking member 88 overlies the body abutment surface 46 to prevent pivoting of the actuator 60 to the open position and (2) a retracted unlocked position (FIGS. 2, 7, and 8) in which the locking member 88 clears the body abutment surface 46 to permit pivoting of the actuator 60 to the open position. To this end, the actuator 60 includes a locking member receiving channel defined by a bottom surface 90 and a pair of opposed side surfaces 92 (FIGS. 3 and 5).

An inwardly extending portion of the recess is bridged by an upper retaining bar 94. Immediately below the bar 94, the actuator defines a rectangular aperture 96. Inwardly of, but adjacent the rectangular aperture 96, is a lower bridge 98 which has an upper surface coplanar with the channel bottom surface 90. Above the lower bridge 98, and adjacent the upper retainer bar 94, is a generally rectangular aperture 100 (FIGS. 3 and 5).

Guide surfaces for the locking member 88 are defined by the channel bottom surface 90, the side surfaces 92, the lower surface of the upper retaining bar 94, the upper surface of the lower bridge 98, and bottom surface of the actuator deck 62 adjacent the rectangular aperture 100.

Figure 3:
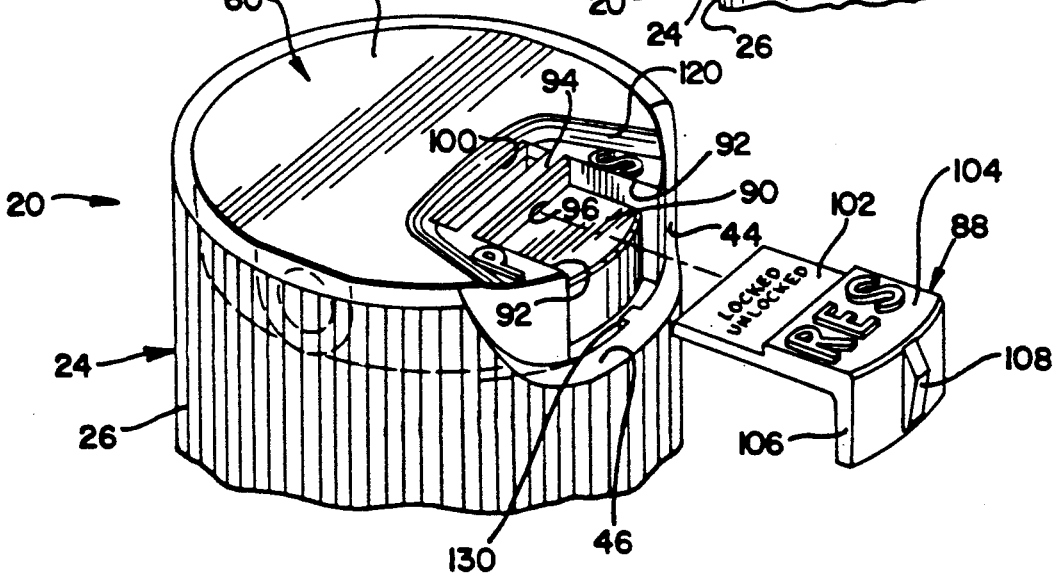
FIG. 3 is an enlarged, fragmentary, partially exploded, perspective view of the closure in the closed orientation.

The locking member 88 has a special configuration which, as illustrated in FIG. 3, includes a horizontal member having a distal end tab 102 and an increased thickness, or stepped, platform 104. A skirt 106 depends downwardly from the end of the platform 104. An angled cam 108 projects rearwardly from the outer, vertical surface of the skirt 106.

The lower surface of the locking member end tab 102 has a small, downwardly projecting, hemispherical protrusion 110 (FIGS. 5 and 7), and the upper surface of the tab 102 is printed or molded with the words "LOCKED" and "UNLOCKED."

During assembly of the closure, the locking member 88 is inserted in the actuator channel with the distal end tab 102 sliding under the upper retaining bar 94 and over the lower bridge 98. Owing to the openings on either side of the upper retaining bar 94 and on either side of the lower bridge 98, the upper retaining bar 94 can flex upwardly and the lower bridge 98 can flex downwardly to accommodate passage of the hemispherical member 110 on the tab 102 during assembly of the closure. However, the amount of force required to slide the tab 102 into the assembled, locked or unlocked, positions (FIGS. 5 or 7, respectively) is relatively great. Accordingly, during normal operation of the assembled closure, complete removal of the locking member 88 from the closure does not occur as increased resistance to pull-out is provided by the engagement between the lower bridge 98 with the hemispherical protrusion 110 (FIG. 5).

When the locking member 88 is in the fully extended, locking position as shown in FIG. 5, the skirt 106 overlies the body abutment surface 46 to prevent pivoting of the actuator 60 to the open position. In the locked closed position (FIG. 5), the word "LOCKED" is visible through the aperture 100 as shown in FIG. 6.

Figure 8:
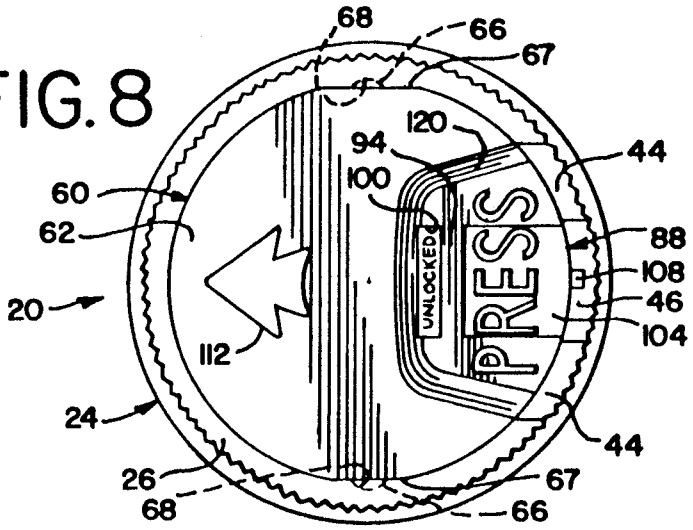
FIG. 8 is a view similar to FIG. 6, but showing the closure in the closed, but unlocked condition.

In order to permit the actuator 60 to be pivoted to the open position, the locking member 88 can be retracted, by pushing it forwardly in the direction of the arrow 112 which is printed or molded on the top of the actuator 60 as shown in FIG. 8. The locking member 88 is moved completely forward until the stepped platform 104 engages the rear vertical surface of the upper retaining bar 94. When the locking member 88 is in this fully retracted position, the word "UNLOCKED" is visible through the aperture 100, and the skirt 106 clears the body abutment surface 46. This permits pivoting of the actuator 60 to the open position (FIG. 7).

The actuator 60 can be pivoted to the open position by applying a downwardly directed force at a first location on the top of the actuator 60. To this end, a rear portion of the actuator deck 62 is recessed within a downwardly sloping surface 120 for receiving the end of a thumb or finger. Further, the recessed surface of the actuator 60 includes a "P" and a "S" which are spaced apart on either side of the locking member receiving channel. The top of the locking member 88 includes the printed or molded letters "RES" for forming the complete word "PRESS" when the locking member 88 is in the fully retracted, unlocked position (FIG. 8). Pressing of the locking member 88 and/or actuator 60 within the recessed area defined by the slanting surface 120 will then cause the actuator 60 to pivot to the open position (FIG. 7).

As illustrated in FIG. 3, the cylindrical wall 26 of the body 24 defines a small, vertically oriented, rib 130 which is radially aligned with the cam 108 on the back of the locking member 88. When the locking member 88 is in the fully retracted, unlocked position and the actuator 60 is pivoted open (FIG. 7), the most rearwardly extending portion of the cam 108 frictionally engages the rib 130. The cam 108 thus serves to stabilize the actuator 60 as it is being pivoted, and the cam 108 provides a frictional engagement with the rib 130 to maintain the actuator 60 in the tilted, open position. The actuator 60 can be returned to the closed position by pushing down on the front part of the actuator, for example, at the arrow 112. The locking member 88 can be left in the unlocked position or moved to the locking position if desired.

It will be appreciated that the sliding movement of the locking tab 88 to the rearwardly extending, locking position can be limited by appropriate design features other than the hemispherical protrusion 110 on the underside of the locking member 88. Such other features may include a wedge or clip shape.

The closure of the present invention can be readily molded from thermoplastic materials in a stream-lined design. The closure provides a desirable toggle-action dispensing operation and at the same time includes a lock for preventing, or reducing the likelihood of, an inadvertent, premature opening or actuation of the closure to the dispensing position.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure for an opening to a container, said closure comprising:

a body for engaging said container over said opening and defining an abutment surface;

an actuator means on said body adjacent said abutment surface for occluding flow from said container when said actuator means is in a closed non-dispensing position and for permitting flow from said container when said actuator means is in an open dispensing position;

mounting means defined by said body and actuator means for pivotally mounting said actuator means on said body to accommodate pivoting movement of said actuator means from said closed position to said open position in response to a force applied to said actuator means at a first location; and a locking member slidably disposed on said actuator means for movement between (1) an extended locked position in which said locking member overlies said body abutment surface to prevent pivoting of said actuator means to said open position and (2) a retracted unlocked position in which said locking member clears said body abutment surface to permit pivoting of said actuator means to said open position.

2. The closure in accordance with claim 1 in which said body includes a pair of spaced-apart recesses each defining an engaging surface that is at least partially spherical;

said body defines a discharge aperture in communication with said container opening; and said actuator means defines a dispensing passage for communicating with said body discharge aperture when said actuator means is in said open position, said actuator means further having a pair of spaced-apart bearing members each defining a bearing surface that is at least partially spherical for engaging one of said recesses to accommodate tilting of said actuator means relative to said body between said open and closed positions.

3. The closure in accordance with claim 1 in which said actuator defines a rearwardly opening channel for receiving said locking member.

4. The closure in accordance with claim 3 in which said actuator means has a bottom surface and a pair of spaced-apart, opposed, vertical side surfaces defining said receiving channel;

said actuator means includes an upper retaining bar extending between said two vertical side surfaces of said channel at a location spaced above said channel bottom surface; and said locking member includes a distal end tab adapted for sliding under said upper retaining bar and on top of said channel bottom surface.

5. The closure in accordance with claim 4 in which said actuator means defines a lower aperture in said receiving channel bottom surface below said upper retaining bar;

said actuator means defines an upper aperture adjacent said upper retaining bar;

said actuator means defines a bridge extending between said two vertical side surfaces of said receiving channel at a location spaced below said upper aperture; and said locking member includes a downwardly projecting hemispherical protrusion on the bottom surface of said locking member distal end tab.

6. The closure in accordance with claim 1 in which said body includes a cylindrical wall;

said body has a finger recess area in the form of a notch in the top edge of said wall;

said abutment surface is defined by the bottom of said notch at said finger recess area; and said locking member is adapted to slide over said abutment surface.

7. The closure in accordance with claim 6 in which said locking member has a downwardly depending skirt for engaging said abutment surface.

8. The closure in accordance with claim 1 in which said actuator means defines a guide channel for receiving said locking member;

said actuator means has a top wall extending over a portion of said channel to define an upper retaining bar and an adjacent, upper aperture communicating with said channel through which a portion of said locking member is visible.

9. The closure in accordance with claim 1 in which said body includes a cylindrical wall;

said body includes a transverse deck extending across said body below the top edge of said cylindrical wall to define a receiving region for said actuator means; and said mounting means mounts said actuator means on said body with a portion of said actuator means being flush with a portion of the top edge of said cylindrical wall.

10. The closure in accordance with claim 1 in which said body has a generally cylindrical configuration defining an outer circumference; and said locking member extends substantially to said circumference when said locking member is in said locked position.

11. A dispensing closure for an opening to a container, said closure comprising:

a body for engaging said container over said opening, said body defining a discharge aperture in communication with said opening and defining an abutment surface;

an actuator on said body adjacent said abutment surface having flow control means for occluding flow from said body discharge aperture when said actuator is in a closed non-dispensing position and for permitting flow through said body discharge aperture from said container when said actuator is in an open dispensing position;

mounting means defined by said body and actuator for pivotally mounting said actuator on said body to accommodate pivoting movement of said actuator from said closed position to said open position in response to a force applied to said actuator means at a first location; and a locking member slidably disposed on said actuator for movement between (1) an extended locked position in which said locking member overlies said body abutment surface to prevent pivoting of said actuator to said open position and (2) a retracted unlocked position in which said locking member clears said body abutment surface to permit pivoting of said actuator to said open position.

* * * * *